US010518332B2

(12) United States Patent
Takaishi et al.

(10) Patent No.: US 10,518,332 B2
(45) Date of Patent: Dec. 31, 2019

(54) METHOD FOR PRODUCING NICKEL POWDER

(71) Applicant: SUMITOMO METAL MINING CO., LTD., Tokyo (JP)

(72) Inventors: Kazuyuki Takaishi, Niihama (JP); Shin-ichi Heguri, Niihama (JP); Ryo-ma Yamaguma, Niihama (JP); Yoshitomo Ozaki, Niihama (JP); Yasuo Doi, Niihama (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 0 days.

(21) Appl. No.: 16/303,313

(22) PCT Filed: May 30, 2017

(86) PCT No.: PCT/JP2017/020044
§ 371 (c)(1),
(2) Date: Nov. 20, 2018

(87) PCT Pub. No.: WO2017/209109
PCT Pub. Date: Dec. 7, 2017

(65) Prior Publication Data

US 2019/0210114 A1 Jul. 11, 2019

(30) Foreign Application Priority Data

May 30, 2016 (JP) ..... 2016-107131

(51) Int. Cl.
*B22F 9/26* (2006.01)
*B22F 9/24* (2006.01)

(52) U.S. Cl.
CPC ..... *B22F 9/24* (2013.01); *B22F 9/26* (2013.01); *B22F 2201/013* (2013.01); *B22F 2201/10* (2013.01); *B22F 2301/15* (2013.01)

(58) Field of Classification Search
None
See application file for complete search history.

(56) References Cited

U.S. PATENT DOCUMENTS

| | | | | |
|---|---|---|---|---|
| 10,118,224 | B2 * | 11/2018 | Yanagisawa | B22F 3/10 |
| 10,220,446 | B2 * | 3/2019 | Yanagisawa | B22F 9/26 |
| 2015/0145183 | A1 | 5/2015 | Matsubara et al. | |
| 2016/0354844 | A1 | 12/2016 | Yanagisawa et al. | |
| 2017/0008083 | A1 | 1/2017 | Yanagisawa et al. | |
| 2017/0008090 | A1 * | 1/2017 | Yanagisawa | B22F 9/26 |
| 2017/0043403 | A1 | 2/2017 | Ozaki et al. | |
| 2018/0257143 | A1 * | 9/2018 | Doi | C22B 3/06 |

FOREIGN PATENT DOCUMENTS

| | | | |
|---|---|---|---|
| JP | 2012-160545 | A | 8/2012 |
| JP | 2015-166489 | A | 9/2015 |
| JP | 2015-212411 | A | 11/2015 |
| WO | 2015/115427 | A1 | 8/2015 |

OTHER PUBLICATIONS

Notice of Reasons for Rejection dated Aug. 29, 2017, issued to JP Application No. 2016-107131 and English translation thereof.
International Search Report dated Jun. 27, 2017, issued for PCT/JP2017/020044.
Office Action dated Dec. 12, 2018, issued in the CA Patent Application No. 3026036.

* cited by examiner

*Primary Examiner* — George Wyszomierski
(74) *Attorney, Agent, or Firm* — Locke Lord LLP; James E. Armstrong, IV; Nicholas J. DiCeglie, Jr.

(57) ABSTRACT

A nickel sulfate amine complex liquid and nickel powder having a particle diameter of 0.1 μm to 300 μm are supplied to a reaction container, hydrogen gas is continuously supplied while the inside of the reaction container is maintained at 150° C. to 250° C., and the pressure is set to 2.5 MPa to 3.5 MPa, whereby nickel ions in the nickel sulfate amine complex liquid are reduced to nickel and deposited on the surfaces of the nickel powder supplied to the reaction container, a reacted slurry including the nickel sulfate amine complex liquid and the nickel powder is then transferred to a pressurized storage container at the same or slightly lower pressure than the internal pressure of the reaction container, and the pressure of the pressurized storage container to which the reacted slurry is transferred is then reduced, after which the reacted slurry is extracted from the pressurized storage container.

6 Claims, No Drawings

METHOD FOR PRODUCING NICKEL POWDER

TECHNICAL FIELD

The present invention relates to a method for producing nickel powder, and specifically, to a method for producing nickel powder by which nickel powder is obtained by hydrogen reduction of a nickel sulfate ammine complex solution in a pressurized container.

BACKGROUND ART

As a method for producing nickel metal using a hydrometallurgical process, for example, there is mentioned a method described in Patent Document 1. Specifically, Patent Document 1 discloses a method in which a treatment of dissolving a raw material containing nickel in a sulfuric acid solution to remove impurities contained in the raw material is performed, ammonia is then added to a nickel sulfate solution from which impurities are separated to form nickel in the form of an ammine complex, this nickel sulfate ammine complex solution is then put in a container, the container is put under a high temperature and a high pressure, and hydrogen gas is blown to the container to reduce nickel ions in the solution, thereby producing nickel powder.

Such a method is an efficient method for obtaining high-quality nickel metal with a compact facility; on the other hand, in a case where the method is performed on an industrial scale, a problem such as durability of the facility is significant.

That is, at the time of industrial execution, when the aforementioned treatment is performed, it is necessary to continuously perform charging of the raw material into a pressurized container and extracting of a reaction product from the pressurized container; however, since a difference in pressure between the reaction container and the outside thereof is extremely large, a flow velocity of a slurry exceeds a velocity of sound at a portion of an extracting port of the reaction container. As a result, a problem arises in that abrasion of the facility caused by a contact between a slurry containing nickel powder to be discharged and the reaction container becomes severe and impact force when the nickel powder collides against the facility after the nickel powder being discharged is large, so that durability of the facility is degraded.

In particular, when coarse nickel powder generated in the pressurized container is handled, for example, a valve of controlling a discharge port is clogged by the nickel powder, and thus there is a concern that opening and closing of the valve cannot be controlled, so that this may also affect operation stability.

A material, which can withstand such abrasion or impact and is suitable for industrial utilization, has not been found yet, maintenance and repair that the facility is frequently stopped for replacing components are necessary, so that a problem such as degradation in productivity due to an increase in cost for maintenance and repair and an increase in repair time arises.

Patent Document 1: Japanese Unexamined Patent Application, Publication No. 2015-212411

DISCLOSURE OF THE INVENTION

Problems to be Solved by the Invention

The present invention is proposed in view of such circumstances, and an object thereof is to provide a method by which nickel powder can be produced inexpensively and stably while wear of the facility caused by abrasion or impact between the facility and the nickel powder occurring when discharged from the pressurized container is prevented.

Means for Solving the Problems

The present inventors have conducted intensive studies in order to solve the aforementioned problems. As a result, they have found a method in which, after a mixed slurry of a nickel sulfate ammine complex solution and nickel powder as seed crystals is charged in a reaction container and hydrogen reduction is performed under pressure while hydrogen gas is continuously supplied to produce reduced nickel powder, when a reacted slurry containing the obtained reduced nickel powder is extracted, the reacted slurry is transferred once to a pressurized storage container (receiving vessel) which is at the same as or slightly lower pressure than an internal pressure of the pressurized reaction container, and subsequently, the reacted slurry is extracted after the pressure of the receiving vessel is gradually reduced to atmospheric pressure. According to this, it has been found that wear of the reaction container can be effectively prevented, and nickel powder can be produced inexpensively and stably, thereby completing the present invention.

(1) A first invention of the present invention is a method for producing nickel powder, the method including: supplying a nickel sulfate ammine complex solution and nickel powder having a particle size of 0.1 μm to 300 μm as seed crystals to a reaction container, continuously supplying hydrogen gas while the inside of the reaction container is maintained at a temperature in a range of 150° C. to 250° C. to set a pressure of a gas phase part inside the reaction container to 2.5 MPa to 3.5 MPa so that nickel ions in the nickel sulfate ammine complex solution are reduced to nickel and the reduced nickel is precipitated on a surface of the nickel powder as seed crystals supplied to the reaction container; subsequently transferring a reacted slurry containing the nickel sulfate ammine complex solution and the nickel powder to a pressurized storage container which is connected to the reaction container and is at the same as or slightly lower pressure than an internal pressure of the reaction container; and subsequently reducing the pressure of the pressurized storage container to which the reacted slurry is transferred, and then extracting the reacted slurry from the pressurized storage container to recover the nickel powder.

(2) A second invention of the present invention is the method for producing nickel powder in the first invention, in which the reacted slurry is transferred from the reaction container to the pressurized storage container in a state where an internal pressure of the pressurized storage container is maintained to be lower than the internal pressure of the reaction container by a range of 0.2 MPa to 1.0 MPa.

(3) A third invention of the present invention is the method for producing nickel powder in the second invention, in which the internal pressure of the pressurized storage container is adjusted and maintained by blowing an inert gas to the pressurized storage container to increase the pressure of the pressurized storage container or discharging the inert gas from the pressurized storage container to reduce the pressure of the pressurized storage container.

(4) A fourth invention of the present invention is the method for producing nickel powder in any one of the first to third inventions, in which the internal pressure of the pressurized storage container is reduced by cooling the inside of the pressurized storage container to 100° C. or lower.

(5) A fifth invention of the present invention is the method for producing nickel powder in any one of the first to fourth inventions, in which the internal pressure of the pressurized storage container to which the reacted slurry is transferred is reduced to atmospheric pressure, the reacted slurry is then extracted from the pressurized storage container, and the extracted reacted slurry is subjected to solid-liquid separation to recover the nickel powder.

Effects of the Invention

According to the present invention, nickel powder can be produced while wear of the facility caused by abrasion or impact between the facility and the nickel powder occurring when discharged from the pressurized container is prevented. According to this, cost necessary for repairing the facility is effectively reduced and a facility operation rate is improved so that nickel powder can be produced inexpensively and stably.

PREFERRED MODE FOR CARRYING OUT THE INVENTION

Hereinafter, a specific embodiment of the present invention (hereinafter, referred to as "the present embodiment") will be described in detail. Incidentally, the present invention is not limited to the following embodiment, and various modifications can be made within the range that does not change the spirit of the present invention. Further, in the present specification, the description "X to Y" (X and Y are arbitrary numerical values) means "X or more and Y or less" unless otherwise specified.

<<1. Regarding Producing of Nickel Powder by Hydrogen Reduction>>

In a method for producing nickel powder according to the present embodiment, a nickel sulfate ammine complex solution is charged in a reaction container and brought into contact with hydrogen gas under pressure to be reduced, thereby obtaining nickel powder.

Specifically, in this method for producing nickel powder, a mixed slurry of a nickel sulfate ammine complex solution and nickel powder as seed crystals is supplied to a reaction container, and hydrogen gas is continuously supplied to adjust the pressure of a gas phase part inside the reaction container while the temperature inside the reaction container is maintained in a predetermined range, so that nickel ions in the nickel sulfate ammine complex solution are reduced to nickel under pressure and the reduced nickel is precipitated on a surface of the nickel powder as seed crystals.

According to such a method, nickel powder having a high quality and an optimal shape can be produced efficiently by continuous operations.

The reaction container is not particularly limited as long as it is a pressurized reaction container which can be adjusted to a predetermined temperature condition and a predetermined pressure condition and maintained. For example, an autoclave or the like can be used. Further, the size thereof can also be appropriately set depending on a treated amount of the mixed slurry of a nickel sulfate ammine complex solution as a raw material and nickel powder as seed crystals, or the like.

The nickel sulfate ammine complex solution is a solution containing nickel in the form of an ammine complex, and can be obtained, for example, by adding ammonia gas or ammonia water ($NH_4OH$) to a nickel sulfate ($NiSO_4$) solution.

When the nickel sulfate ammine complex solution is produced, the concentration of ammonia to be added is not particularly limited, but for example, it is preferable to add ammonia to be 1.9 or more in a molar ratio with respect to the nickel concentration in the solution. According to this, it can be prevented that nickel in the solution becomes nickel hydroxide deposition without forming an ammine complex.

As the nickel powder to be added as seed crystals, nickel powder with an average particle size of 0.1 μm to 300 μm is preferably used, and nickel powder with an average particle size of 10 μm to 200 μm is more preferably used. When the particle size of the nickel powder as seed crystals is less than 0.1 μm, the nickel powder is too fine, and thus there is a possibility that the effect as seed crystals is not obtainable. On the other hand, when the particle size of the nickel powder as seed crystals is more than 300 μm, the nickel powder is coarse, and thus the effect of suppressing abrasion of the facility is not obtainable and it is economically disadvantageous that such coarse nickel powder is prepared.

As the nickel powder as seed crystals, commercially available nickel powder can be used, and nickel powder chemically precipitated by a known method can be classified and used. Further, nickel powder obtained by the producing method according to the present embodiment can also be repeatedly used.

Incidentally, the nickel powder as seed crystals is continuously supplied together with a nickel sulfate ammine complex solution as a raw material to the reaction container by using a supply device such as a slurry pump.

The temperature inside the reaction container, that is, the reaction temperature of hydrogen reduction reaction is set to a range of 150° C. to 250° C. Further, the temperature is set preferably to 150° C. to 185° C. The temperature inside the reaction solution is adjusted, for example, by heating using a heating device or the like, and is maintained.

Regarding the reaction temperature, when the reaction temperature is lower than 150° C., reduction efficiency of nickel ions in the nickel sulfate ammine complex solution is degraded, which is not preferable. On the other hand, even when the reaction temperature is higher than 250° C., the reduction reaction is not affected, and instead, the loss of hydrogen gas to be supplied to the reaction container increases. Further, the loss of thermal energy occurs.

Further, in this producing method, in a state where the temperature of the reaction container is maintained at 150° C. to 250° C., hydrogen gas is continuously supplied to the gas phase part at which the solution is not filled in the reaction container, such that the pressure of the gas phase part is set in a range of 2.5 MPa to 3.5 MPa. Specifically, hydrogen gas is directly blown to the gas phase part in the reaction container, for example, from a cylinder or the like, or is blown into the slurry.

Regarding the pressure of the gas phase part, when the internal pressure is less than 2.5 MPa, the efficiency of reduction reaction of nickel ions is degraded. On the other hand, even by setting a high pressure condition such that the internal pressure is more than 3.5 MPa, the reduction reaction is not affected, and instead, the loss of the supplied hydrogen gas increases.

As described above, in the method for producing nickel powder according to the present embodiment, hydrogen gas is blown to the mixed slurry of a nickel sulfate ammine complex solution and nickel powder as seed crystals to adjust the pressure to a predetermined pressure, so that nickel ions contained in the nickel sulfate ammine complex solution is reduced to nickel under pressure. According to this, nickel generated by reduction is precipitated on the surface of the nickel powder supplied as seed crystals so that reduced nickel powder can be obtained.

<<2. Extraction of Reacted Slurry Using Receiving Vessel>>

Conventionally, after a reacted slurry containing reduced nickel powder (hereinafter, referred to "reacted slurry") is obtained as described above, the reacted slurry is extracted from a reaction container and transferred, for example, to a solid-liquid separation device or the like, thereby separating and recovering the reduced nickel powder. At this time, since the reacted slurry is generated by reduction reaction under pressure in the reaction container, the reacted slurry is discharged from an extracting port of the reaction container at an extremely high flow velocity, and as a result, abrasion easily occurs in the reaction container due to a contact with the slurry flowing at a high velocity (more specifically, the nickel powder contained in the slurry), so that durability is degraded.

Herein, in the present embodiment, a charging port of a pressurized storage container (hereinafter, also referred to as "receiving vessel") is connected to the extracting port (discharge port) of the reaction container, and then the reacted slurry containing the reduced nickel powder generated in the reaction container is transferred to the receiving vessel. Further, the internal pressure of the receiving vessel in which the reacted slurry is charged is gradually reduced, and then the reacted slurry is extracted.

That is, when the reacted slurry containing the reduced nickel powder generated in the reaction container is extracted, the pressure of the reaction container is not reduced to atmospheric pressure at once, but the reacted slurry is transferred once to the receiving vessel, which is at the same as or slightly lower pressure than the internal pressure of the pressurized reaction container, and subsequently, the pressure of the receiving vessel is gradually reduced to atmospheric pressure and the reacted slurry is then extracted. Incidentally, the internal pressure of the pressurized reaction container is a pressure when the reacted slurry is obtained, and is in a range of about 2.5 MPa to 3.5 MPa described above.

According to such a method, rapid discharging of the slurry from the reaction container can be suppressed, occurrence of abrasion due to the nickel powder at the discharge port of the reaction container or impact after extracting can be prevented. Further, according to this, the stable operation of the facility can be achieved, and the frequency of repairing of the reaction container (facility) can also be effectively reduced.

Specifically, a difference in pressure between the pressurized reaction container and the receiving vessel is set preferably to a range of 0.2 MPa to 1.0 MPa. That is, in a state where the internal pressure of the pressurized storage container is maintained to be lower than the internal pressure of the reaction container, preferably by a range of 0.2 MPa to 1.0 MPa, the reacted slurry is transferred from the reaction container to the pressurized storage container.

When the difference in pressure between the reaction container and the receiving vessel is less than 0.2 MPa, the extracting (transferring) of the reacted slurry from the reaction container hardly proceeds, and thus there is a possibility that work efficiency is degraded. On the other hand, when the difference in pressure is more than 1.0 MPa, the discharge speed from the reaction container increases excessively, and thus there is a possibility that abrasion or impact of the discharge port of the reaction container and equipment such as a valve attached to the discharge port cannot be suppressed effectively.

When the reacted slurry is transferred from the reaction container to the receiving vessel, it is preferable that the pressure of the receiving vessel is increased in advance by blowing an inert gas. The inert gas is not particularly limited as long as it does not affect properties of the reduced nickel powder as a product, and nitrogen gas, argon gas, helium gas, or the like can be used.

Further, when the difference in pressure between the reaction container and the receiving vessel is adjusted, for example, to a range of 0.2 MPa to 1.0 MPa, as described above, the internal pressure of the receiving vessel can be adjusted and maintained by blowing an inert gas to the receiving vessel to increase the pressure of the receiving vessel or discharging the inert gas from the receiving vessel to reduce the pressure of the receiving vessel.

Then, when the receiving vessel to which the reacted slurry is transferred is reduced in pressure, as a pressure reduction operation of the receiving vessel, the pressure reduction operation can be performed by gradually opening a valve provided in the gas phase part. Further, for example, a method of reducing the pressure by providing a jacket (cooling jacket) outside the receiving vessel and causing a cooling medium such as water or oil to flow to the jacket to cool the entire receiving vessel after the reacted slurry is transferred to the receiving vessel or before the reacted slurry is transferred may be used.

Specifically, the internal pressure thereof is reduced, for example, by cooling the temperature inside the receiving vessel to 100° C. or lower. By cooling the temperature inside the receiving vessel to a temperature equal to or lower than 100° C. in this way, the internal pressure can be efficiently set to be the same as atmospheric pressure, and the reacted slurry can be safely and stably extracted.

Herein, the receiving vessel is not particularly limited as long as it is a storage container in which pressurization and pressure reduction operations can be efficiently performed. Further, the size thereof can also be appropriately set depending on quantities of the mixed slurry of a nickel sulfate ammine complex solution and nickel powder as seed crystals which is supplied to the reaction container, a time necessary for reducing the receiving vessel in pressure, or the like.

Further, as the receiving vessel, two or more receiving vessels are connected in parallel to one reaction container and a transfer destination from the reaction container may be selected. By doing this, in a case where the storage amount in one receiving vessel is full, transferring is continued by switching the other receiving vessel, and in the meantime, the one receiving vessel which is full is reduced in pressure to extract the reacted slurry, and then the pressure thereof is increased again such that the one receiving vessel can be prepared for switching. According to this, hydrogen gas is supplied to the nickel sulfate ammine complex solution charged in the reaction container to continuously cause reaction and the obtained reacted slurry can also be efficiently extracted.

Further, two or more receiving vessels are connected in series to the reaction container, and sequentially, for example, the pressure may be gradually reduced while a difference in pressure of 0.2 MPa to 1.0 MPa described above is maintained.

Incidentally, when the reacted slurry is extracted from the receiving vessel after the receiving vessel is reduced in pressure, the reacted slurry is transferred, for example, to a solid-liquid separation device or the like and is subjected to a solid-liquid separation treatment, so that the obtained reduced nickel powder can be separated and recovered.

EXAMPLES

Hereinafter, the present invention will be described in more detail by means of Examples of the present invention, but the present invention is not limited to the following Examples at all.

Example 1

In a reaction container (pressurized container) using an autoclave with an inner capacity of 190 L, 90 L of a solution composed of 362 g/L of ammonium sulfate and 100 g/L of nickel powder was charged, the reaction container was tightly sealed, and then the temperature in the reaction container was increased to 185° C. and maintained. Then, hydrogen gas was blown to a gas phase part of the reaction container so that the internal pressure of the gas phase part thereof was adjusted to 2.5 MPa and maintained.

Further, a charging port of a receiving vessel with a capacity of 580 L was connected to a discharge valve of a discharge port of the reaction container, nitrogen gas was caused to pass through the inside of the receiving vessel to replace the inside of the receiving vessel with air, and then the internal pressure of the receiving vessel was increased to 2.0 MPa and maintained.

Then, a nickel sulfate ammine complex solution with a nickel concentration of 75 g/L and a starting solution composed of ammonium sulfate with a concentration of 330 g/L were continuously added to the reaction container at a rate of 1 L per minute, and a nickel powder slurry with a concentration of 150 g/L using nickel powder with a particle size of 30 μm was continuously added to the reaction container at a rate of 0.5 L per minute. Further, hydrogen gas in a cylinder was blown such that the internal pressure of the reaction container was maintained at 2.5 MPa, and thus hydrogen reduction reaction occurred.

The reacted slurry (nickel powder slurry) was transferred to the receiving vessel while the liquid volume of the reaction container was managed in a range of 90 L±5 L. Incidentally, this transfer operation was performed for 45 minutes.

Then, a heating medium was caused to flow into a jacket provided at the circumference of the receiving vessel to perform indirect cooling. After receiving the nickel powder slurry, an atmosphere opening valve of the receiving vessel was gradually opened to reduce the pressure to atmospheric pressure, and then the nickel powder slurry was extracted from the receiving vessel.

Incidentally, the temperature of the nickel powder slurry was 56° C. Further, the amount of the nickel powder slurry recovered in the receiving vessel was 65.5 L (1.46 L/min in terms of flow rate) and the slurry concentration of the nickel slurry was 53 g/L.

Then, the obtained nickel powder slurry was subjected to solid-liquid separation using a Nutsche funnel to be separated into the nickel powder (reduced nickel powder) and the reacted nickel sulfate ammine complex solution. The average particle size of the nickel powder obtained by separating and recovering in this way was 75 μm. Further, after completion of the reaction in the reaction container, the discharge valve or piping of the reaction container and the inside of the receiving vessel were observed, and as a result, abrasion, damage, or the like was not observed.

Comparative Example 1

In Comparative example 1, similarly to Example 1, nickel powder was grown by using a nickel sulfate ammine complex solution, nickel powder as seed crystals, and hydrogen gas, and then the grown nickel powder was transferred to a receiving vessel connected to a reaction container. At this time, the internal pressure of the receiving vessel was set to the same as atmospheric pressure.

After completion of the reaction in the reaction container, the discharge valve or piping of the reaction container and the inside of the receiving vessel were observed, as a result, abrasion caused by the generated nickel powder, damage in the inner wall caused by collision of the nickel powder, or the like was observed, so that it was determined that the reaction container does not withstand against use application over a long period time thereafter.

The invention claimed is:

1. A method for producing nickel powder, the method comprising:

supplying a nickel sulfate ammine complex solution and nickel powder having a particle size of 0.1 μm to 300 μm as seed crystals to a reaction container, continuously supplying hydrogen gas to set a pressure of a gas phase part inside the reaction container to 2.5 MPa to 3.5 MPa while the inside of the reaction container is maintained at a temperature in a range of 150° C. to 250° C. so that nickel ions in the nickel sulfate ammine complex solution are reduced to nickel and the reduced nickel is precipitated on a surface of the nickel powder as seed crystals supplied to the reaction container so as to obtain reduced nickel powder;

subsequently transferring a reacted slurry containing the nickel sulfate ammine complex solution and the reduced nickel powder to a pressurized storage container which is connected to the reaction container and is maintained at the same as an internal pressure of the reaction container or lower than the internal pressure of the reaction container by a range of 0.2 MPa to 1.0 MPa; and subsequently reducing the pressure of the pressurized storage container to which the reacted slurry is transferred, and then extracting the reacted slurry from the pressurized storage container to recover the reduced nickel powder.

2. The method for producing nickel powder according to claim 1, wherein the internal pressure of the pressurized storage container is adjusted and maintained by blowing an inert gas to the pressurized storage container to increase the pressure of the pressurized storage container or discharging the inert gas from the pressurized storage container to reduce the pressure of the pressurized storage container.

3. The method for producing nickel powder according to claim 1, wherein the internal pressure of the pressurized storage container is reduced by cooling the inside of the pressurized storage container to 100° C. or lower.

4. The method for producing nickel powder according to claim 1, wherein the internal pressure of the pressurized storage container to which the reacted slurry is transferred is reduced to atmospheric pressure, the reacted slurry is then extracted from the pressurized storage container, and the extracted reacted slurry is subjected to solid-liquid separation to recover the nickel powder.

5. The method for producing nickel powder according to claim 2, wherein the internal pressure of the pressurized storage container is reduced by cooling the inside of the pressurized storage container to 100° C. or lower.

6. The method for producing nickel powder according to claim 2, wherein the internal pressure of the pressurized storage container to which the reacted slurry is transferred is reduced to atmospheric pressure, the reacted slurry is then extracted from the pressurized storage container, and the extracted reacted slurry is subjected to solid-liquid separation to recover the nickel powder.

* * * * *